United States Patent [19]

Mey

[11] 4,108,657

[45] Aug. 22, 1978

[54] MULTI-ACTIVE PHOTOCONDUCTIVE ELEMENT WITH AN AGGREGATE AND INORGANIC PHOTOCONDUCTOR

[75] Inventor: William Mey, Rochester, N.Y.

[73] Assignee: Eastman Kodak Company, Rochester, N.Y.

[21] Appl. No.: 641,058

[22] Filed: Dec. 15, 1975

Related U.S. Application Data

[63] Continuation-in-part of Ser. No. 534,978, Dec. 20, 1974, abandoned.

[51] Int. Cl.[2] ..... G03G 5/09; G03G 5/06

[52] U.S. Cl. ..... 96/1.6; 96/1.5 R

[58] Field of Search ..... 96/1.5, 1.6, 1.7, 1.8

[56] References Cited

U.S. PATENT DOCUMENTS

| | | | |
|---|---|---|---|
| 3,041,166 | 6/1962 | Bardeen | 96/1.5 |
| 3,165,405 | 1/1965 | Hoesterey | 96/1.7 |
| 3,615,414 | 10/1971 | Light | 96/1.6 |
| 3,679,405 | 7/1972 | Makino et al. | 96/1.6 |
| 3,725,058 | 4/1973 | Hayashi et al. | 96/1.6 |
| 3,732,180 | 5/1973 | Gramza et al. | 96/1.6 |
| 3,791,826 | 2/1974 | Cherry et al. | 96/1.8 |
| 3,973,962 | 8/1976 | Contois et al. | 96/1.6 |

*Primary Examiner*—David Klein
*Assistant Examiner*—John L. Goodrow
*Attorney, Agent, or Firm*—Ronald P. Hilst

[57] ABSTRACT

A multi-active photoconductive insulating element is disclosed having at least two layers comprising an inorganic photoconductor-containing layer and an aggregate photoconductive layer. The aggregate photoconductive layer contains a continuous polymeric phase having dispersed therein a co-crystalline complex composed of (i) at least one polymer having an alkylidene diarylene group in a recurring unit and (ii) at least one pyrylium-type dye salt.

26 Claims, No Drawings

MULTI-ACTIVE PHOTOCONDUCTIVE ELEMENT WITH AN AGGREGATE AND INORGANIC PHOTOCONDUCTOR

This application is a continuation-in-part of Mey, U.S. Ser. No. 534,978, filed Dec. 20, 1974 now abandoned.

Cross-reference is made to Berwick et al., U.S. Ser. No. 639,039, filed Dec. 19, 1975, a continuation-in-part application of Ser. No. 534,979, filed Dec. 20, 1974 and entitled "Multi-Active Photoconductive Element I".

FIELD OF THE INVENTION

This invention relates to electrophotography and particularly to an improved photoconductive insulating element for use in various electrophotographic processes.

BACKGROUND OF THE INVENTION

Electrophotographic imaging processes and techniques have been extensively described in both the patent and other literature, for example, U.S. Pat. Nos. 2,221,776; 2,277,013; 2,297,691; 2,357,809; 2,551,582; 2,825,814; 2,833,648; 3,220,324; 3,220,831; 3,220,833 and many others. Generally, these processes have in common the steps of employing a photoconductive insulating element which is prepared to respond to imagewise exposure with electromagnetic radiation by forming a latent electrostatic charge image. A variety of subsequent operations, now well-known in the art, can then be employed to produce a permanent record of the image.

Various types of photoconductive insulating element are known for use in electrophotographic imaging processes. In many conventional elements, the active components of the photoconductive insulating composition are contained in a single layer composition. This composition is typically affixed, for example, to a conductive support during the electrophotographic imaging process.

Among the many different kinds of photoconductive compositions which may be employed in typical single active layer photoconductive elements are inorganic photoconductive materials such as vacuum evaporated selenium, particulate zinc oxide dispersed in a polymeric binder, homogeneous organic photoconductive compositions composed of an organic photoconductor solubilized in a polymeric binder, and the like.

Other especially useful photoconductive insulating compositions which may be employed in a single active layer photoconductive element are the high speed "heterogeneous" or "aggregate" photoconductive compositions described in Light, U.S. Pat. No. 3,615,414 issued Oct. 26, 1971 and Gramza et. al., U.S. Pat. No. 3,732,180 issued May 8, 1973. These aggregate-containing photoconductive compositions have a continuous electrically insulating polymer phase containing a finely-divided, particulate, co-crystalline complex of (i) at least one pyrylium-type dye salt and (ii) at least one polymer having an alkylidene diarylene group in a recurring unit.

In addition to the various single active layer photoconductive elements such as those described above, various photoconductive elements having more than one active layer have been described in the art. One useful type of "multiactive-layer" photoconductive element is described in Hoesterey, U.S. Pat. No. 3,165,405 issued Jan. 12, 1965, at column 2, lines 6–20 thereof. As described in this patent, photoconductivity is achieved by applying a uniform positive charge to the surface of an element containing two layers of zinc oxide, a sensitized zinc oxide bottom layer and an unsensitized zinc oxide upper layer, and then exposing the sensitized bottom layer to a pattern of activating radiation. Photoconductivity is produced in the element by the electrical interaction of the two zinc oxide layers. The sensitized zinc oxide bottom layer generates photoelectrons, i.e. negative charge carriers, and injects these charge carriers into the unsensitized zinc oxide upper layer which accepts and transports these charge carriers to the positively charged surface of the photoconductive element.

The concept of using two or more active layers in a photoconductive element has been discussed in the patent literature. Such multi-active-layer photoconductive elements are sometimes referred to hereinafter simply as "multi-active" photoconductive elements. In addition to the above-noted Hoesterey patent, a partial listing of representative patents discussing or at least referring to "multi-active" photoconductive elements includes: Bardeen, U.S. Pat. No. 3,041,166 issued June 26, 1962; Makino, U.S. Pat. No. 3,394,001 issued July 23, 1968; Makino et. al. U.S. Pat. No. 3,679,405 issued July 25, 1972; Hayaski et. al., U.S. Pat. No. 3,725,058 issued Apr. 3, 1973; Canadian Pat. No. 930,591 issued July 24, 1973; Canadian Pat. Nos. 932,197 – 199 issued Aug. 21, 1973; and British Pat. Nos. 1,343,671 and 1,337,228.

Although there has been a fairly extensive description of specific types of multi-active photoconductive elements in the literature, various shortcomings still exist in these elements so that there is a need to investigate alternative kinds of multi-active elements. For example, the multi-active elements described in the aforementioned Hoesterey patent suffer from the disadvantages of using generally low speed and difficult to clean zinc oxide materials in both active layers of the element. Other multi-active elements such as those described in Canadian patent Nos. 930,591 and 932,199 appear to be primarily designed for use in a positive charging mode of operation and therefore may not generally be suitable for use in an electrophotographic process in which a negative charging mode is employed.

In addition to the above-noted problems and shortcomings associated with prior art multi-active photoconductive elements, it should be noted that, to applicant's knowledge, the art, to date, has not disclosed any type of multi-active photoconductive element which uses and takes advantage of the above-mentioned high-speed aggregate photoconductive compositions described in Light, U.S. Pat. No. 3,615,414, except as may be described in Seus, U.S. Pat. No. 3,591,374 issued July 6, 1971. The aforementioned Seus patent describes a photoconductive element employing an aggregate photoconductive composition overcoated with a solution of a sensitizing dye of the type useful in preparing the initial aggregate photoconductive composition, i.e., a pyrylium-type dye salt, whereby the overcoated dye imbibes into and interacts with the aggregate photoconductive composition to provide an increase in electrophotographic speed of the resultant aggregate composition. In this regard, it is also noted that Berwick et al., U.S. Ser. No. 639,039, filed Dec. 9, 1975, and cross-referenced hereinabove, describes a type of multi-active photoconductive element which includes a layer employing the aggregate compositions described in U.S.

Pat. No. 3,615,414 together with an organic photoconductor-containing charge-transport layer.

Because of the commercial need for improved aggregate photoconductive compositions, particularly those exhibiting one or more of the following properties: easier cleaning, greater resistance to wear and abrasion, improved panchromatic response, and higher electrophotographic speeds, it would be advantageous to develop new types of multi-active elements which employ and improve on the existing aggregate photoconductive compositions.

SUMMARY OF THE INVENTION

In accord with the present invention there is provided a multi-active photoconductive element having at least two layers comprising a selenium-containing or zinc oxide-containing inorganic photoconductor-containing layer in electrical contact with an aggregate photoconductive layer. The aggregate photoconductive layer which is present in the multi-active element of the present invention contains a continuous, electrically insulating polymer phase and, dispersed in the continuous phase, a discontinuous phase comprising a finely-divided, particulate, co-crystalline complex of (i) at least one polymer having an alkylidene diarylene group in a recurring unit and (ii) at least one pyrylium-type dye salt.

In accord with one useful embodiment of the invention relating to multi-active photoconductive elements sensitive to visible light, i.e. light in the region of from about 400 to 700 nm, the aggregate photoconductive layer is characterized by having its principal absorption band of radiation in the visible region of the spectrum within the range of from about 520 nm to about 700 nm.

The inorganic photoconductor-containing layer used in the multi-active elements of the invention is composed of a photoconductive electrically insulating composition containing at least one selenium-containing or zinc oxide-containing inorganic photoconductor and, if useful or desirable, an electrically insulating binder material.

In accord with those particularly useful embodiments of the invention wherein the multi-active element is sensitive to visible light or other radiation such as X-rays, it is advantageous to select as the inorganic photoconductor-containing layer a composition such as selenium which exhibits absorption in that portion of the spectrum below about 600 nm. In accord with this embodiment, the inorganic photoconductor-containing layer is sensitive to radiation in a lower region of the spectrum and the aggregate photoconductive layer is sensitive to radiation in an upper region of the spectrum. In this embodiment of the invention, the inorganic photoconductor-containing layer, for example, selenium, may be colored or opaque so that it is capable of transmitting only a portion of or no radiation in the region of the spectrum to which the aggregate photoconductive layer is sensitive. In such case, exposure of the aggregate photoconductive layer to activating radiation is advantageously made by exposing the multi-active element of the invention from the rear, i.e., by exposing the surface of the aggregate layer which is opposite the inorganic photoconductor-containing layer so that activating radiation for the aggregate layer need not pass through the inorganic photoconductor-containing layer before contacting the aggregate layer.

It should be understood that the multi-active photoconductive element of the invention may be employed as the radiation-sensitive electrical image forming member in a variety of electrophotographic processes including transfer electrophotographic processes employing a reusable photoconductive element; non-transfer electrophotographic processes wherein a final visible image is formed on a non-reusable photoconductive element; the so-called TESI process (ie. Transer of ElectroStatic Images) such as described by R. M. Schaffert in the book entitled *Electrophotography,* The Focal Press, New York (1965); etc. For convenience and purposes of illustration, the multi-active photoconductive element of the invention will be described herein with reference to its use in conventional electrophotographic processes in which an electrostatic charge image is formed on the surface of the photoconductive element by employing the now well known steps of (a) applying a uniform electrostatic charge to the top surface of the photoconductive element in the absence of activating radiation while the bottom surface of the element is maintained at a suitable potential thereby creating an electric field through the photoconductive element and (b) imagewise exposing the photoconductive element to activating radiation. However, it will be appreciated by those familiar with the art that the multi-active element of the invention may also be advantageously employed in a wide variety of other known electrophotographic processes.

In accord with the various embodiments of the present invention, the above-described multi-active, photoconductive insulating element may be employed in electrophotographic processes using either positive or negative charging of the photoconductive element. Typically, when the multi-active photoconductive element is employed in an electrophotographic process, the element is affixed, either permanently or temporarily, on a conductive support. In such case, by appropriate selection of the photoconductive material in the inorganic photoconductor-containing layer, the multi-active element is capable of providing useful electrostatic charge images when used in either a positive or negative charge mode, regardless of whether the aggregate photoconductive layer or the inorganic photoconductor-containing layer is located adjacent the conductive support.

In accord with certain embodiments of the invention, when the element is to be used in a negative charging mode, it is particularly advantageous (a) to employ an inorganic photoconductor-containing layer having its principal radiation absorption band below about 600 nm, (b) to place an aggregate photoconductive layer having its principal absorption in the region of 520 to 700 nm adjacent to a conductive support which is transparent to exposing radiation and (c) to expose this multi-active element of the invention from the rear, i.e., exposing the element to radiation by directing the exposing radiation through the transparent conductive support into contact with the aggregate photoconductive layer (where a portion of the radiation is absorbed) and then into contact with the inorganic photoconductor-containing layer (where an additional portion of the radiation is absorbed).

DESCRIPTION OF THE PREFERRED EMBODIMENTS

Before proceeding with a detailed description of the various materials which may be employed in the multi-active photoconductive element of the invention, a description of the electrical operation occurring in the multi-active photoconductive element of the invention when employed in a conventional electrophotographic imaging process will be helpful to gain a better understanding of the present invention.

In conventional electrophotographic imaging processes in which the multi-active photoconductive element may be employed, the element is typically affixed, at least temporarily, to a conductive support maintained at a given reference potential and a uniform electrostatic charge of opposite polarity is applied to the surface of the multi-active element opposite the conductive support in the absence of activating radiation.

The term "activating radiation" as used in the present specification refers to radiation which is capable of generating charge carriers, i.e., electron-hole pairs, in both the inorganic photoconductor containing layer and the aggregate photoconductive layer upon exposure of the multi-active element of the invention.

The uniform electrostatic charge applied to the surface of the multi-active element of the invention is held at or near the surface due to the electrical insulating properties of the multi-active element in the absence of activating radiation. As noted earlier herein, either the aggregate photoconductive layer or the inorganic photoconductor-containing layer may be used as the surface layer of the multi-active photoconductive element of the invention, and these layers are in electrical contact with one another so that charge carriers generated in one of the layers can flow into the other layer. The electrical resistivity of the multi-active photoconductive insulating element of the invention (as measured across the inorganic photoconductor-containing layer and the aggregate photoconductive layer in the absence of activating radiation) should be at least about $10^9$ ohm-cms at 25° C. In general, it is advantageous to use multi-active elements having a resistivity one or more orders of magnitude higher than $10^{10}$ ohm-cms, for example, elements having an electrical resistivity greater than about $10^{14}$ ohm-cms at 25° C.

There are actually several different modes of operation possible with the element of the present invention using conventional electrophotographic techniques. Although, as explained hereinafter, the present invention has been found to provide higher sensitivity and more efficient operation in certain of these modes of operation than in other of these modes, it is possible to use the present invention in each of these different modes.

For purposes of illustration, the various modes of operation possible, when the multi-active photoconductive element of the invention is employed in conventional electrophotographic processes, will be described herein in terms of the different structural configurations of the multi-active element.

Considering that configuration of the multi-active element wherein the aggregate photoconductive composition is temporarily or permanently affixed to a conductive support and the inorganic photoconductor-containing layer is coated over the aggregate photoconductive layer, the following modes of operation are possible:

(1) The surface of the inorganic photoconductor-conducting layer may be given an initial uniform positive polarity charge and the multi-active element subjected to an imagewise exposure pattern of activating radiation. In this case, positive charge carriers, i.e. holes, photogenerated by activating radiation in either the inorganic photoconductor-containing layer or the underlying aggregate photoconductive layer are transported through the multi-active element to the opposite polarity reference potential maintained at the interface between the aggregate photoconductive layer and the conducting support. Negative charge carriers, i.e. electrons, photogenerated by activating radiation in either the inorganic photoconductor-containing layer or the aggregate photoconductive layer are transported through the multi-active element to the uniform positive polarity charge initially applied to the surface of the inorganic photoconductor-containing layer and tend to neutralize the initial uniform positive charge in those areas of the element which were contacted by activating radiation, thereby forming a charge pattern corresponding to the original imagewise radiation exposure pattern.

(2) The surface of the inorganic photoconductor-containing layer may be given an initial uniform negative polarity charge and the multi-active element subjected to an imagewise pattern of activating radiation. In this case, the negative charge carriers photogenerated in either the inorganic photoconductor-containing layer or the underlying aggregate photoconductive layer are transported through the multi-active element to the opposite polarity reference potential maintained at the interface between the aggregate photoconductive layer and the conducting support. Positive charge carriers photogenerated by activating radiation in either of the layers of the element are transported through the element to the uniform polarity negative charge initially applied to the surface of the inorganic photoconductor-containing layer and tend to neutralize the initial uniform negative charge in those areas of the element which were contacted by activating radiation, thereby forming a charge pattern corresponding to the original imagewise radiation exposure pattern.

As will be apparent to those familiar with the art of electrophotography, two modes of operation for the multi-active element of the invention similar to those described above are possible when the structural configuration of the element is reversed, i.e. where the inorganic photoconductor-containing layer is temporarily or permanently affixed to a conductive support and the aggregate photoconductive layer is coated over the inorganic photoconductor-containing layer.

The overall electrical speed for a specific multi-active element of the invention will depend on a number of factors. One important factor is the total number of charge carriers generated in the element. The number of charge carriers generated in both of the layers of the multi-active element depends upon the sensitivity of these layers to the specific activating radiation employed in a given situation and the amount of activating radiation which actually impinges on each layer. In addition, the overall electrical speed of a particular multi-active element will also depend on the capability of a particular aggregate photoconductive layer to accept and transport charge carriers generated from a particular inorganic photoconductor-containing layer and vice versa.

One particularly useful aspect of the present invention is the fact that both layers of the multi-active element of the invention can generate charge carriers, i.e. holes or electrons, and inject them into the other layer, which, in turn, can transport these injected charge carriers. That is, the aggregate photoconductive layer can transport charge carriers, for example, electrons injected into it from the selenium-containing or zinc oxide-containing inorganic photoconductive layer; and the aggregate photoconductive layer can, in turn, generate its own charge carriers and inject them into the selenium-containing or zinc oxide-containing inorganic photoconductive layer. In this regard, it should be noted that there are inorganic photoconductive materials other than selenium-containing and zinc oxide-containing materials which are excellent photoconductors in their own right; however, many of these materials are not completely photoelectrically compatible with the aggregate photoconductive composition used in the present invention. That is, such inorganic photoconductive materials either will not easily and efficiently inject charge carriers into the aggregate photoconductive layer or they will not readily accept and transport charge carriers generated from within the aggregate photoconductive composition. Accordingly, although one can, in fact, combine the aggregate photoconductive composition used in the present invention with a variety of different inorganic photoconductive compositions and achieve some improvement in photosensitivity; in very few of these cases does one achieve the excellent photoelectrical compatibility which is achieved using the particular combination of materials set forth in the present invention wherein each of the aggregate photoconductive layer and the selenium-containing or zinc oxide-containing inorganic photoconductive layer can (a) transport charge carriers injected into it from the other layer and (b) inject charge carriers into the other layer.

In accord with one embodiment of the present invention wherein a multi-active element having good panchromatic response to visible light and high electrical speed is provided, an aggregate photoconductive layer, having its principal absorption band of visible radiation in the visible region of the spectrum within the range of from about 520 nm to about 700 nm, is located adjacent a conductive support; and a selenium-containing photoconductive layer, having an absorption band in the visible spectrum within the range of from about 400 to about 600 mn, is applied over the aggregate photoconductive layer. In this embodiment, when visible light impinges on the element, the selenium-containing layer responds to light in the shorter wavelength region of the visible spectrum and the aggregate photoconductive layer responds to visible light in the longer region of the visible spectrum. Especially good results have been obtained in accord with this embodiment of the invention wherein (1) a thin layer of amorphous selenium is used as the inorganic photoconductor-containing layer, (2) the element is subjected to an initial uniform polarity negative charge and (3) exposure of the multi-active element is made from the rear, i.e. through the conductive support which therefore must be transparent to visible light.

In accord with other embodiments of the invention wherein multi-active elements are provided having an extended range of radiation sensitivity, for example to radiation in the ultraviolet or X-ray region of the spectrum, it is advantageous to employ zinc oxide or selenium-containing inorganic photoconductors which are sensitive to radiation in these regions of the spectrum in the inorganic photoconductor-containing layer. In these embodiments of the invention, it is advantageous to employ inorganic photoconductors having absorption maxima below 400 nm, for example, in the region of from 0.01 nm to 400 nm.

The inorganic photoconductor-containing layer of the multi-active element of the invention contains as an essential component one or more selenium-containing or zinc oxide-containing inorganic photoconductive materials. The term "inorganic photoconductor" as used herein is defined as any inorganic photoconductive element or compound, including inorganic polymers, consisting solely of inorganic molecules. A partial list of representative selenium-containing photoconductors useful in the invention includes selenium, includes the various structural forms of selenium such as metallic selenium and amorphous selenium, cadmium selenide, arsenic triselenide, and the like.

The inorganic photoconductor-containing layer used in the present invention may be composed solely of an inorganic photoconductor, such as a vacuum evaporated selenium layer (with or without various known sensitizer(s) or dopant(s) for the selenium-containing layer), or it may be composed of a mixture of inorganic photoconductor in an electrically insulating binder together with any necessary or desired sensitizer or dopant materials. The total amount of inorganic photoconductor employed together with an electrically insulating binder material, when one is used, may vary considerably. Typically, the amount of inorganic photoconductor(s) used in admixture with an electrically insulating binder varies within the range of from about 5 to about 99 percent by weight, preferably 50 to about 90 weight percent, based on the total weight of the inorganic photoconductor-containing layer.

A partial listing of representative materials which may be employed as binders in the inorganic photoconductor-containing layer are film-forming polymeric materials having a fairly high dielectric strength and good electrically insulating properties. Such binders include styrene-butadiene copolymers; polyvinyl toluene-styrene copolymers; styrene-alkyd resins; silicone-alkyd resins; soya-alkyd resins; vinylidene chloride-vinyl chloride copolymers; poly(vinylidene chloride); vinylidene chloride-acrylonitrile copolymers; vinyl acetate-vinyl chloride copolymers; poly(vinyl acetals), such as poly(vinyl butyral); nitrated polystyrene; polymethylstyrene, isobutylene polymers; polyesters, such as poly[ethylene-coalkylenebis(alkyleneoxyaryl) phenylenedicarboxylate]; phenolformaldehyde resins; ketone resins; polyamides; polycarbonates; polythiocarbonates; poly[ethylene-co-isopropylidene-2,2-bis-(ethyleneoxyphenylene)terephthalate]; copolymers of vinyl haloarylates and vinyl acetate such as poly(vinyl-m-bromobenzoate-co-vinyl acetate); chlorinated poly(olefins) such as chlorinated poly(ethylene); etc. Methods of making resins of this type have been described in the prior art, for example, styrene-alkyd resins can be prepared according to the method described in Gerhart U.S. Pat. No. 2,361,019, issued Oct. 24, 1944 and Rust U.S. Pat. No. 2,258,423, issued Oct. 7, 1941. Suitable polymers of the type contemplated for use in the inorganic photoconductor-containing layers of the invention are sold under such tradenames as VITEL PE-101, CYMAC, Piccopale 100, Saran F-220, and LEXAN 145. Other types of binders which can be used in the inorganic photoconductor-containing layers include such material as paraffin, mineral waxes, etc., as well as combinations of binder materials.

The thickness of the inorganic photoconductor-containing layer may vary. In accord with certain preferred embodiments of the invention wherein a vacuum-deposited inorganic photoconductive layer, e.g. vacuum-deposited selenium, is employed as the inorganic photoconductor-containing layer, best results are generally obtained when the aggregate photoconductive layer is from about 1 to about 200 times, preferably 2 to about 50 times, as thick as the inorganic photoconductor-containing layer. In such case a useful thickness layer for a vacuum-deposited inorganic photoconductive layer is within the range of from about 0.1 to about 5 microns thickness, preferably from about 0.1 to about 2 microns. In accord with other embodiments of the invention wherein the inorganic photoconductor-containing layer contains a binder, the inorganic photoconductor-containing layer may be thicker, thinner, or have a thickness equal to that of the contiguous aggregate photoconductive layer. In such case a useful thickness for the inorganic photoconductor-containing layer is within the range of from about 0.5 to about 50 microns, although thinner or thicker layers may also be used.

As indicated above, the inorganic photoconductor-containing layer may also contain, if necessary or desirable depending on the particular inorganic photoconductors(s) selected and the specific spectral and electrical speed response desired, an effective amount of one or more sensitizers or dopants for the inorganic photoconductor. Sensitizing compounds useful with the inorganic photoconductive compounds of the present invention can be selected from a wide variety of materials, including such materials as pyrylium dye salts including thiapyrylium dye salts and selenapyrylium dye salts disclosed in VanAllan et al U.S. Pat. No. 3,250,615; fluorenes, such as 7,12-dioxo-13-dibenzo(a,h)fluorene, 5,10-dioxo-4a,11-diazobenzo(b)fluorene, 3,13-dioxo-7-oxadibenzo(b,g)fluorene, and the like; aromatic nitro compounds of the kinds described in U.S. Pat. No. 2,610,120; anthrones like those disclosed in U.S. Pat. No. 2,670,284; quinones, U.S. Pat. No. 2,670,286; benzophenones U.S. Pat. No. 2,670,287; thiazoles, U.S. Pat. No. 2,732,301; mineral acids; carboxylic acids, such as maleic acid, dichloroacetic acid, trichloroacetic acid, and salicyclic acid, sulfonic and phosphoric acids, and various dyes, such as cyanine (including carbocyanine), merocyanine, diarylmethane, thiazine, azine, oxazine, xanthene, phthalein, acridine, azo, anthraquinone dyes and the like and mixtures thereof.

Where a sensitizing compound is employed in the inorganic photoconductor-containing layer to form a sensitized layer, it is the normal practice, when the inorganic photoconductor-containing layer is applied as a liquid coating dope, to mix a suitable amount of the sensitizing compound with the coating composition so that, after thorough mixing, the sensitizing compound is uniformly distributed in the coated layer. Other methods of incorporating the sensitizer or the effect of the sensitizer may, however, be employed consistent with the practice of this invention. For example, when the inorganic photoconductor-containing layer is applied by vacuum deposition such as a vacuum deposited selenium layer, one or more impurities or dopants may be co-vacuum deposited with the inorganic photoconductor as sensitizer to sensitize the layer. When a sensitizer is employed in a particular inorganic photoconductor-containing layer, the amount of sensitizer that can be added to the photoconductor-containing layer to give effective changes in spectral response or increases in speed can vary widely. The optimum concentration in any given case wil vary with the specific photoconductor and sensitizing compound used. In general, useful results can be obtained where an appropriate sensitizer is added in a concentration range from about 0.001 to about 30 percent by weight based on the dry weight of the inorganic photoconductor-containing layer. Normally, when used, a sensitizer is added to the layer in an amount by weight from about 0.005 to about 10.0 percent by weight of the layer.

The inorganic photoconductor-containing layer may also contain other addenda such as leveling agents, surfactants, plasticizers and the like to enhance or improve various physical properties of the layer.

Liquid coating vehicles useful for coating inorganic photoconductor-containing layers (which include a binder) onto a suitable substrate can include a wide variety of aqueous and organic vehicles. Typical organic coating vehicles include:

(1) Aromatic hydrocarbons such as benzene, naphthalene, etc., including substituted aromatic hydrocarbons such as toluene, xylene, mesitylene, etc.;

(2) Ketones such as acetone; 2-butanone, etc.;

(3) Halogenated aliphatic hydrocarbons such as methylene chloride, chloroform, etylene chloride, etc.;

(4) Ethers including cyclic ethers such as tetrahydrofuran, ethylether;

(5) Mixtures of the above.

As noted earlier herein, in accord with certain preferred embodiments of the invention whereby a multiactive photoconductive element having enhanced panchromatic spectral response and increased electrical speed is obtained, it is advantageous to select the individual inorganic photoconductor and sensitizer components of the inorganic photoconductor-containing layer to provide a resultant layer having an absorption band in a region of the spectrum below about 600 nm.

The aggregate photoconductive compositions have a multiphase structure containing (1) a continuous, electrically insulating, film-forming polymer phase and dispersed in the continuous phase (a) a discontinuous phase comprising a finely-divided, particulate, co-crystalline complex of (i) at least one polymer having an alkylidene diarylene group in a recurring unit and (ii) at least one pyrylium type dye salt. Optionally, further addenda such as one or more photocnductive and/or sensitizing materials may advantageously be dispersed in or in solid solution with the continuous polymer phase of the above-described aggregate photoconductive composition. Of course, these multiphase aggregate photoconductive compositions may also contain other addenda such as leveling agents, surfactants, plasticizers, and the like to enhance or improve various physical properties and/or electrophotographic response characteristics of the composition.

The aggregate photoconductive compositions used in this invention may be prepared by several techniques, such as, for example, the so-called "dye first" technique described in Gramza et al, U.S. Pat. No. 3,615,396, issued Oct. 26, 1971. Alternatively, they may be prepared by the so-called "shearing" method described in Gramza, U.S. Pat. No. 3,615,415, issued Oct. 26, 1971. This latter method involves the high speed shearing of the photoconductive composition prior to coating and thus eliminates subsequent solvent treatment, as was disclosed in Light, U.S. Pat. No. 3,615,414 referred to above. By whatever method prepared, the aggregate composition is applied with a suitable liquid coating vehicle onto a suitable support to form a separately identifiable multiphase aggregate photoconductive composition, the heterogeneous nature of which is generally apparent when viewed under magnification, although such compositions may appear to be substantially optically clear to the naked eye in the absence of magnification. There can, of course, be macroscopic heterogeneity. Suitably, the pyrylium type dye salt-containing aggregate in the discontinuous phase is finely-divided, i.e., typically predominantly in the size range of from about 0.01 to about 25 microns.

The term co-crystalline complex as used herein has reference to a crystalline compound which contains pyrylium type dye salt and alkylidene diarylene group-containing polymer molecules co-crystallized in a single crystalline structure to form a regular array of the molecules in a three-dimensional pattern.

Another feature characteristic of the aggregate compositions formed as described herein is that the wavelength of the radiation absorption maximum characteristic of such compositions is substantially shifted from the wavelength of the radiation absorption maximum of a substantially homogeneous dye-polymer solid solution formed of similar constituents. The new absorption maximum characteristic of the aggregates formed by this method is not necessarily an overall maximum for this system as this will depend upon the relative amount of dye in the aggregate. Such an absorption maximum shift in the formation of aggregate systems for the present invention is generally of the magnitude of at least about 10 nm. If mixtures of dyes are used, one dye may cause an absorption maximum shift to a long wavelength and another dye cause an absorption maximum shift to a shorter wavelength. In such cases, a formation of the aggregate compositions can more easily be identified by viewing under magnification.

Sensitizing dyes and electrically insulating polymeric materials are used in forming these aggregate compositions. Typically, pyrylium type dye salts, including pyrylium, bispyrylium, thiapyrylium and selenapyrylium dye salts and also salts of pyrylium compounds containing condensed ring systems such as salts of benzopyrylium and naphthopyrylium dyes are useful in forming such compositions. Dyes from these classes which may be useful are disclosed in Light, U.S. Pat. No. 3,615,414.

Particularly useful dyes in forming the feature aggregates are pyrylium dye salts having the formula:

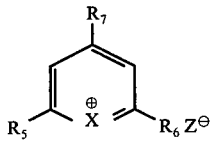

wherein:

$R_5$ and $R_6$ can each be phenyl groups, including substituted phenyl groups having at least one substituent chosen from alkyl groups of from 1 to about 6 carbon atoms and alkoxy groups having from 1 to about 6 carbon atoms;

$R_7$ can be an alkylamino-substituted phenyl group having from 1 to 6 carbon atoms in the alkyl group, and including the dialkylamino-substituted and haloalkylamino-substituted phenyl groups;

X can be an oxygen, selenium, or a sulfur atom; and $Z^{\ominus}$ is an anion.

The polymers useful in forming the aggregate compositions include a variety of materials. Particularly useful are electrically insulating, film-forming polymers having an alkylidene diarylene group in a recurring unit such as those linear polymers, including copolymers, containing the following group in a recurring unit:

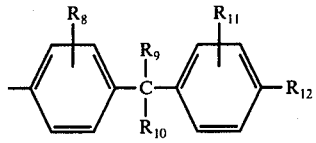

wherein:

$R_9$ and $R_{10}$, when taken separately, can each be a hydrogen atom, an alkyl group having from one to about 10 carbon atoms, such as methyl, ethyl, isobutyl, hexyl, heptyl, octyl, nonyl, decyl, and the like including substituted alkyl groups such as trifluoromethyl, etc., and an aryl group such as phenyl and naphthyl, including substituted aryl radicals having such substituents as a halogen atom, an alkyl group of from 1 to about 5 carbon atoms, etc.; and $R_9$ and $R_{10}$, when taken together, can represent the carbon atoms necessary to complete a saturated cyclic hydrocarbon group including cycloalkanes such as cyclohexyl and polycycloalkanes such as norbornyl, the total number of carbon atoms in $R_9$ and $R_{10}$ being up to about 19;

$R_8$ and $R_{11}$ can each be hydrogen, an alkyl group of from 1 to about 5 carbon atoms, e.g., or a halogen such as chloro, bromo, iodo, etc.; and $R_{12}$ is a divalent group selected from the following:

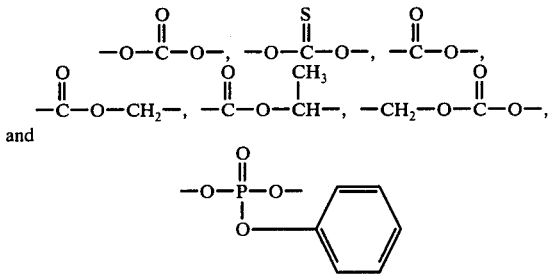

Preferred polymers useful for forming aggregate crystals are hydrophobic carbonate polymers containing the following group in a recurring unit:

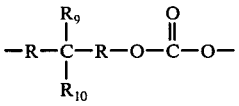

wherein:

each R is a phenylene group including halo substituted phenylene groups and alkyl substituted phenylene groups; and $R_9$ and $R_{10}$ are as described above. Such compositions are disclosed, for example, in U.S. Pat. Nos. 3,028,365 and 3,317,466. Preferably polycarbonates containing an alkylidene diarylene group in the recurring unit such as those prepared with Bisphenol A and including polymeric products of ester exchange between diphenylcarbonate and 2,2-bis-(4-hydroxyphenyl)propane are useful in the practice of this invention. Such compositions are disclosed in the following U.S. Patents: U.S. Pat. Nos. 2,999,750 by Miller et al, issued Sept. 12, 1961; 3,038,874 by Laakso et al, issued June 12, 1962; 3,038,879 by Laakso et al, issued June 12, 1962; 3,038,880 by Laakso et al, issued June 12, 1962; 3,106,544 by Laakso et al, issued Oct. 8, 1963; 3,106,545 by Laakso et al, issued Oct. 8, 1963; and 3,106,546 by Laakso et al, issued Oct. 8, 1963. A wide range of film-forming polycarbonate resins are useful, with completely satisfactory results being obtained when using commercial polymeric materials which are characterized by an inherent viscosity of about 0.5 to about 1.8.

The following polymers are included among the materials useful in the practice of this invention:

Table 1

| No. | Polymeric Material |
|---|---|
| 1 | poly(4,4'-isopropylidenediphenylene-co-1,4-cyclohexylenedimethylene carbonate) |
| 2 | poly(ethylenedioxy-3,3'-phenylene thiocarbonate) |
| 3 | poly(4,4'-isopropylidenediphenylene carbonate-co-terephthalate) |
| 4 | poly(4,4'-isopropylidenediphenylene carbonate) |
| 5 | poly(4,4'-isopropylidenediphenylene thiocarbonate) |
| 6 | poly(4,4'-sec-butylidenediphenylene carbonate) |
| 7 | poly(4,4'-isopropylidenediphenylene carbonate-block-oxyethylene) |
| 8 | poly(4,4'-isopropylidenediphenylene carbonate-block-oxytetramethylene) |
| 9 | poly[4,4'-isopropylidenebis(2-methylphenylene)-carbonate] |
| 10 | poly(4,4'-isopropylidenediphenylene-co-1,4-phenylene carbonate) |
| 11 | poly(4,4'-isopropylidenediphenylene-co-1,3-phenylene carbonate) |
| 12 | poly(4,4'-isopropylidenediphenylene-co-4,4'-diphenylene carbonate) |
| 13 | poly(4,4'-isopropylidenediphenylene-co-4,4-'-oxydiphenylene carbonate) |
| 14 | poly(4,4'-isopropylidenediphenylene-co-4,4'-carbonyldiphenylene carbonate) |
| 15 | poly(4,4'-isopropylidenediphenylene-co-4,4'-ethylenediphenylene carbonate) |
| 16 | poly[4,4'-methylenebis(2-methylphenylene)carbonate] |
| 17 | poly[1,1-(p-bromophenylethylidene)bis(1,4-phenylene)carbonate] |
| 18 | poly[4,4'-isopropylidenediphenylene-co-4,4'-sulfonyldiphenylene) carbonate] |
| 19 | poly[4,4'-cyclohexylidene(4-diphenylene) carbonate] |
| 20 | poly[4,4'-isopropylidenebis(2-chlorophenylene) carbonate] |
| 21 | poly(4,4'-hexafluoroisopropylidenediphenylene carbonate) |
| 22 | poly(4,4'-isopropylidenediphenylene 4,4'-isopropylidenedibenzoate) |
| 23 | poly(4,4'-isopropylidenedibenzyl 4,4'-isopropylidenedibenzoate |
| 24 | poly[4,4'-(1,2-dimethylpropylidene)diphenylene carbonate] |
| 25 | poly[4,4'-(1,2,2-trimethylpropylidene)-diphenylene carbonate] |
| 26 | 4,4'-[1-(α-naphthyl)ethylidene]-diphenylene carbonate} |
| 27 | poly[4,4'-(1,3-dimethylbutylidene)-diphenylene carbonate] |
| 28 | poly[4,4'-(2-noroornylidene)diphenylene carbonate] |
| 29 | poly[4,4'-(hexahydro-4,7-methancindan-5-ylidene) diphenylene carbonate] |

The amount of the above-described pyryliumtype dye salt used in the aggregate photoconductive compositions described herein may vary considerably. Useful results are obtained by using the described pyryliumtpye dye salts in amounts of from about 0.001 to about 50 percent by weight of the aggregate photoconductive composition. When the present aggregate compositions also contain other photoconductive materials in the aggregate photoconductive coatings, useful results are obtained by using the described dye salts in amount of about 0.001 to about 30 percent by weight of the aggregate photoconductive composition, although the amount used can be widely varied depending upon such factors as individual dye salt solubility, the polymer contained in the continuous phase, and any other photoconductive materials which may be present, the electrophotographic response desired, the mechanical properties desired, etc. Similarly, the amount of alkylidene diarylene group-containing polymer used in the aggregate photoconductive composition of the multi-active element of the invention may vary considerably. Typically, the aggregate photoconductive composition contains an amount of this polymer within the range of from about 20 to about 98 weight percent based on the weight of the aggregate composition, although larger or smaller amounts may also be used.

If desired, other polymers can be incorporated in the aggregate photoconductive compositions used in the present invention, for example, to alter physical properties such as adhesion of the aggregate photoconductive layer to the support and the like. Techniques for the preparation of aggregate photoconductive layers containing such additional polymers are described in C. L. Stephens, U.S. Pat. No. 3,679,407, issued July 25, 1974, and entitled METHOD OF FORMING HETEROGENEOUS PHOTOCONDUCTIVE COMPOSITIONS AND ELEMENTS.

As noted above, further addenda such as organic or inorganic photoconductive and/or sensitizing materials may advantageously be incorporated in the aggregate photoconductive compositions described herein. For improved electrical speed in the multiactive element of the invention it is especially advantageous to incorporate one or more organic photoconductors in solid solution with the continuous polymer phase of the aggregate photoconductive composition. A variety of such organic photoconductors are known. A partial listing of representative such organic photoconductors includes the following:

Arylamine photoconductors including substituted and unsubstituted arylamines, diarylamines, nonpolymeric triarylamines and polymeric triarylamines such as those described in Fox U.S. Pat. No. 3,240,597, issued Mar. 15, 1966, and Klupfedl et al U.S. Pat. No. 3,180,730, issued Apr. 27, 1965.

Polyarylalkane photoconductors of the types described in Noe et al U.S. Pat. No. 3,274,000, issued Sept. 20, 1966; Wilson U.S. Pat. No. 3,542,547, issued Nov. 24, 1970; Seus et al U.S. Pat. No. 3,542,544, issued Nov. 24, 1970; Rule U.S. Pat. No. 3,615,402, issued Oct. 26, 1971; and in Rule et al copending application Ser. No. 639,040, filed Dec. concurrently herewith and entitled "Photoconductive Composition and Elements Containing Same".

4-Diarylamino-substituted chalcones of the types described in Fox U.S. Pat. No. 3,526,501, issued Sept. 1, 1970.

Non-ionic cycloheptenyl compounds of the types described in Looker U.S. Pat. No. 3,533,786, issued Oct. 13, 1970.

Compounds containing an >N-N< nucleus, as described in Fox U.S. Pat. No. 3,542,546, issued Nov. 24, 1970.

Organic compounds having a 3,3'-bis-aryl-2-pyrazoline nucleus, as described in Fox et al U.S. Pat. No. 3,527,602, issued Sept. 8, 1970.

Triarylamines in which at least one of the aryl radicals is substituted by either a vinyl radical or a vinylene radical having at least one active hydrogen-containing group, as described in Brantly et al. U.S. Pat. No. 3,567,450, issued Mar. 2, 1971.

Triarylamines in which at least one of the aryl radicals is substituted by an active hydrogen-containing group, as described in Brantly et al. Belgian Pat. No. 728,563, dated Apr. 30, 1969.

Organo-metallic compounds having at least one aminoaryl substituent attached to a Group IVa or Group Va metal atom, as described in Goldman et. al. Canadian Pat. No. 818,539, dated July 22, 1969.

Organo-metallic compounds having at least one aminoaryl substituent attached to a Group IIIa metal atom, as described in Johnson Belgian Pat. No. 735,334, dated Aug. 29, 1969.

Charge transfer combinations, e.g., those comprising a photoconductor and a Lewis acid, as well as photoconductive compositions involving complexes of non-photoconductive material and a Lewis acid, such as described, for example, in Jones U.S. Defensive Publication T881,002, dated Dec. 1, 1970 and Mammino U.S. Pat. Nos. 3,408,181 through 3,408,190, all dated Oct. 29, 1968 and Inami et. al. U.S. Pat. No. 3,418,116, dated Dec. 24, 1968.

Other types of organic photoconductors include azourethanes; heterocyclic compounds such as carbazoles, oxazoles, benzothiazoles, imidazoles, tetrazacyclooctotetraenes etc; aromatic hydrocarbons such as acenaphthene, anthracene, phenanthrene, etc. as well as polymers containing the same; aromatic nitro compounds such as 2,4,7-trinitrofluoren-9-one, trinitrobenzene, etc.; ketonic compounds such as benzil, chloranil, benzophenone, etc.; polymeric materials such as polyvinylcarbazole and halogenated counterparts, polymers of formaldehyde and aromatic hydrocarbons, etc., as well as mixtures of such materials with Lewis acids; pigments such as phthalocyanine; dyes such as Rhodamine B, crystal violet, etc.; and many others.

When an optional inorganic or organic photoconductor, such as noted above, is incorporated in the aggregate photoconductive composition used in the present invention, the amount which is used may vary depending on the particular photoconductive material, its compatibility, for example, solubility in the continuous polymeric binder phase of the aggregate photoconductive composition, and the like. Good results have been obtained using an amount of photoconductor in the aggregate photoconductive layer within the range of from about 2 to about 50 weight percent based on the weight of the aggregate photoconductive layer. Larger or smaller amounts may also be used.

Optional overcoat layers may be used in the present invention, if desired. For example, to improve surface hardness and resistance to abrasion, the surface layer of the multiactive element of the invention may be coated with one or more electrically insulating, organic polymer coatings or electrically insulating, inorganic coatings. A number of such coatings are well known in the art and accordingly extended discussion thereof is unnecessary. Typical useful such overcoats are described, for example, in *Research Disclosure,* "Electrophotographic Elements, Materials, and Processes", Volume 109, page 63, Paragraph V, May, 1973, which is incorporated by reference herein.

In addition, when the multi-active element of the invention is temporarily or permanently affixed to an electrically conducting support one or more interlayers such as an adhesive subbing layer and/or electrical barrier layer may be interposed between the multiactive element and the conducting support to improve adhesion to the support and/or the electrical performance of the element. These interlayers may be composed of an organic polymeric material such as a vinylidene chloride-containing copolymer of an inorganic material. A number of such interlayers are known in the art and accordingly extended discussion thereof is unnecessary. Typical useful such interlayers are described, for example, in *Research Disclosure,* "Electrophotographic Elements, Materials, and Processes", Volume 109, page 62, Paragraph III, May 1973, which is incorporated by reference herein.

The multi-active elements of the invention may be affixed, if desired, to a variety of electrically conducting supports, for example, paper (at a relative humidity above 20 percent); aluminum-paper laminates; metal foils such as aluminum foil, zinc foil, etc.; metal plates, such as aluminum, copper, zinc, brass and galvanized plates; vapor deposited metal layers such as silver, nickel, aluminum and the like coated on paper or conventional photographic film bases such as cellulose acetate, polystyrene, etc. Such conducting materials as nickel can be vacuum deposited on transparent film supports in sufficiently thin layers to allow electrophotographic elements prepared therewith to be exposed from either side of such elements. An especially useful conducting support can be prepared by coating a support material such as poly(ethylene terephthalate) with a conducting layer containing a semiconductor dispersed in a resin or vacuum deposited on the support. Such conducting layers both with and without insulating barrier layers are described in U.S. Pat. No. 3,245,833 by Trevoy, issued Apr. 12, 1966. Other useful conducting layers include compositions consisting essentially of an intimate mixture of at least one protective inorganic oxide and from about 30 to about 70 percent by weight of at least one conducting metal, e.g., a vacuum-deposited cermet conducting layer as described in Rasch, U.S. Ser. No. 486,284, filed July 8, 1974. Likewise, a suitable conducting coating can be prepared from the sodium salt of a carboxyester lactone of maleic anhydride and a vinyl acetate polymer. Such kinds of conducting layers and methods for their optimum preparation and use are disclosed in U.S. Pat. Nos. 3,007,901 by Minsk, issued Nov. 7, 1961 and 3,262,807 by Sterman et al, issued July 26, 1976.

The following examples are presented herein merely to illustrate, not to limit, the present invention.

EXAMPLE 1

An aggregate photoconductor layer of the type described in Example 1 of U.S. Pat. No. 3,615,396 was coated at a dry thickness of about 10 microns at a dry coverage of about 10,100 mg./m.$^2$, over a transparent nickel-coated poly(ethylene terephthalate) film support to form a conventional single-layer aggregate photoconductive element. The composition of the dry aggregate layer was approximately 39 weight percent of 4,4'-diethylamino-2,2'-dimethyltriphenylmethane, approximately 59 weight percent of Lexan® 145 bisphenol A polycarbonate sold by General Electric Co., and about 2 weight percent of 4-(4-dimethylaminophenyl)-2,6-diphenyl-thiapyrylium fluoroborate aggregated with the Lexan® 145 as described in Example 1 of U.S. Pat. No. 3,615,396. One sample of this single layer aggregate photoconductive element was retained as a control. A second sample of this single layer aggregate photoconductive element was formed into a multiactive element of the invention by vacuum-depositing a 1 micron layer of amorphous selenium at a residual pressure of about $2 \times 10^{-5}$ torr.

The electrophotographic response of both of the above elements was measured using conventional techniques involving low-intensity continuous exposures as follows:

In a first test, the amorphous selenium surface of the multi-active element was charged to a uniform negative potential of −500 volts, exposed from the front, i.e., a Xenon exposing light source was focused directly on the negatively charged selenium surface, and the energy required to discharge the multi-active element to −100 volts was measured over a succession of 20 nm increments extending throughout the range of 400 to 700 nm. This same test was then performed on the single layer aggregate photoconductive control element. As a result, it was found that the sensitivity of the multi-active element was about a factor of ten higher than the aggregate control element at 460 nm, and the sensitivity of the multi-active element was about a factor of twenty below that of the control element at 560 nm.

In a second test, the amorphous selenium surface of the multi-active element was again charged negatively and exposed as in the first test, but the exposure was made from the rear of the element, i.e., the exposing light was incident upon the transparent, nickel-coated poly(ethylene terephthalate) film base. This same test was then performed on the single layer aggregate photoconductive control element. As a result, it was found that the multi-active element exhibited exceptionally high, substantially panchromatic sensitivity extending throughout the entire visible spectrum. At 460 nm. the sensitivity of the multi-active element was a factor of ten higher than the sensitivity of the aggregate control, and at 560 nm. the multi-active element exhibited a sensitivity equal to that of the control.

A third and fourth test were also performed using the multi-active element prepared as described in this Example. These tests were run just as the first and second tests described above, except that in these two tests the initial uniform charge was of positive polarity. In the third test using an exposure impinging directly on the selenium surface of the multi-active element (as in the first test above), the multi-active element exhibited little sensitivity to visible light in the 400–550 nm. range but exhibited good sensitivity to visible light in the 560–700 nm. range. In the fourth test, the multi-active element was exposed from the rear (as in the second test above). In this test the multi-active element exhibited good sensitivity to visible light throughout the visible spectrum although a definite loss in sensitivity was detected in that region of the visible spectrum extending from 425 to about 500 nm.

The results of these tests indicated that the multi-active element described in this Example exhibited good sensitivity over a substantial portion of the visible spectrum when used in both a positive and negative charging mode and with both front rear exposures. The results further indicated, that the multi-active element of this Example exhibited exceptionally high sensitivity throughout the entire visible spectrum when used in a negative charging mode with a rear exposure.

EXAMPLE 2

A series of additional multi-active photoconductive insulating elements were prepared in this example using amorphous selenium, ZnO, PbO, and CdS in the inorganic photoconductor-containing layer, as shown in Table 2. The inorganic photoconductors Se, ZnO, PbO, and CdS were coated over a 10 micron thick single-layer aggregate photoconductive layer (as described in Ex. 1) which, in turn, was coated on a transparent, nickel-coated poly(ethylene) terephthalate) film support (also as described in Ex. 1). The inorganic photoconductors ZnO, PbO, and CdS were coated in a binder over the aggregate photoconductor layer. The binders used were poly(vinyl acetate:maleate) for ZnO and poly(vinyl butyral) for PbO and CdS. The inorganic photoconductor-containing layer composed of PbO and binder was about 7 microns thick and contained about 5 parts by weight PbO and 1 part by weight of binder. The layer composed of CdS and binder was also about 7 microns thick and contained about 4 parts by weight of CdS and 1 part by weight binder. The layer composed of ZnO and binder was about 5 microns thick and contained about 6 parts by weight ZnO and 1 part by weight of binder. The inorganic photoconductor Se was coated over the aggregate photoconductor layer as described in Example 1. The values quoted in Table 2 for the relative energy needed to discharge the multi-active photoconductive elements from 500 to 100 volts were obtained for negative charging (the inorganic photoconductor-containing layers were charged negatively), rear exposure (light incident to support) and front exposure (light incident to inorganic photoconductor-containing layer).

Table 2

| Sample | Relative Energy to Discharge Photoconductor Element From −500 volts to −100 volts | |
|---|---|---|
| | Rear Exposure | Front Exposure |
| Single layer aggregate photoconductive element (Control) | 1** | 1** |
| Multi-active element of the invention with vacuum deposited amorphous selenium as the inorganic photoconductor-contaning layer. | 0.1 (460 nm.)[f] | 0.1 (460 nm.)[f] |
| Multi-active element of the invention with ZnO in the inorganic photoconductor-containing layer | 0.3 (350 nm.) | 0.5 (370 nm.)<br>0.3 (350 nm.) |
| Multi-active element with PbO in the inorganic photoconductor-containing layer (Control) | 0.7 (450 nm.) | — |
| Multi-active element with CdS in the inorganic photoconductor-containing layer (Control) | 0.9 (510 nm.)<br>0.8 (450 nm.) | >1.0 (510 nm.)<br>>1.0 (450 nm.) |

**The control is arbitrarily assigned a valur of 1 in each column
[f]The wavelength of the exposure radiation.

The results of the tests conducted in Example 2, as indicated in Table 2, showed that the Se, ZnO, PbO, and CdS-containing multi-active elements exhibited greater radiation sensitivity than a conventional single layer aggregate photoconductive element (one of the control elements of Table 2) in regions of the spectrum below about 450 nm. However, it was particularly noteworthy that the selenium and zinc oxide-containing multi-active element exhibits a significantly greater increase in radiation sensitivity than either the lead oxide- or cadmium sulfide-containing multi-active elements used as controls in Table 2. Upon further investigation of this matter, it was found that both selenium and zinc oxide-containing inorganic photoconductive layers, such as those shown in Table 2 of this example, were capable of (a) efficient injection of charge carriers into an aggregate photoconductive layer and (b) efficient transport of charge carriers generated by the aggregate photoconductive layer. In contrast, lead oxide, although capable of transporting charge carriers injected into it by the aggregate photoconductive layer, was not found capable of efficiently injecting charge carriers into an aggregate photoconductive layer. A similar problem was found upon investigation of the photoelectrical compatibility existing between an aggregate photoconductive layer and a cadmium sulfide-containing inorganic photoconductive layer. In this latter case, CdS was found capable of transporting charge carriers injected into it by an aggregate photoconductive layer. However, it was determined that CdS could not inject positive charge carriers, i.e., holes, into an aggregate photoconductive layer. CdS was found to be capable of injecting negative charge carriers, i.e., electrons, into an aggregate photoconductive layer, but no apparent increase in sensitivity over that exhibited by the aggregate photoconductive layer alone, without CdS, could be detected.

The invention has been described in detail with particular reference to certain preferred embodiments thereof, but it will be understood that variations and modifications can be effected within the spirit and scope of the invention.

I claim:

1. A photoconductive insulating element having at least two layers comprising an aggregate photoconductive layer in electrical contact with an inorganic photoconductor-containing layer, (a) said aggregate photoconductive layer comprising a continuous, electrically insulating polymer phase and dispersed in said continuous phase a discontinuous phase comprising a finely-divided, particulate, co-crystalline complex of (i) at least one polymer having an alkylidene diarylene group in a recurring unit and (ii) at least one pyrylium-type dye salt, the particulate, co-crystalline complex of said discontinuous phase having a size of about 0.01 to about 25 microns, said aggregate photoconductive layer having a maximum radiation absorption at a wavelength at least about 10 nm. different from the wavelength of maximum absorption of said pyrylium-type dye salt solubilized with said alkylidene diarylene group-containing polymer in a homogeneous composition, (b) said inorganic photoconductor-containing layer comprising an inorganic zinc oxide or selenium-containing photoconductor.

2. A photoconductive insulating element as defined in claim 1 wherein said inorganic photoconductor-containing layer comprises the inorganic photoconductor dispersed in an electrically insulating polymeric binder.

3. A photoconductive insulating element as defined in claim 1 wherein said inorganic photoconductor-containing layer consists essentially of the inorganic photoconductive material.

4. A photoconductive insulating element having at least two layers comprising an aggregate photoconductive layer in electrical contact with an inorganic photoconductor-containing layer, (a) said aggregate photoconductive layer comprising an organic photoconductive material in solid solution with a continuous, electrically insulating polymer phase and dispersed in said continuous phase a discontinuous phase comprising a finely-divided particulate, co-crystalline complex of (i) at least one polymer having an alkylidene diarylene group in a recurring unit and (ii) at least one pyrylium-type dye salt, the particulate, co-crystalline complex of said discontinuous phase having a size of about 0.01 to about 25 microns, said aggregate photoconductive layer having a maximum radiation absorption at a wavelength at least about 10 nm. different from the wavelength of maximum absorption of said pyrylium-type dye salt solubilized with said alkylidene diarylene group-containing polymer in a homogeneous composition, (b) said inorganic photoconductor-containing layer comprising an inorganic zinc oxide or selenium-containing photoconductor.

5. A photoconductive insulating element as defined in claim 4 wherein said inorganic photoconductor-containing layer comprises the inorganic photoconductor in an insulating polymeric binder and sensitizer for said inorganic photoconductor.

6. A photoconductive insulating element as defined in claim 4 wherein said inorganic photoconductor-containing layer consists essentially of the inorganic photoconductive material and a sensitizer for said material.

7. A photoconductive insulating element having at least two layers comprising an aggregate photoconductive layer in electrical contact with an inorganic photoconductor-containing layer, (a) said aggregate photoconductive layer having a dry thickness 1 to about 200 times thicker than said inorganic photoconductor-containing layer and comprising a continuous, electrically insulating polymer phase and dispersed in said continuous phase a discontinuous phase comprising a finely-divided, particulate, co-crystalline complex of (i) at least one polymer having an alkylidene diarylene group in a recurring unit and (ii) at least one thiapyrylium dye salt, said aggregate photoconductor layer having its principal absorption band of visible radiation within the range of from about 520 to about 700 nm, the particulate, co-crystalline complex of said discontinuous phase having a size of about 0.01 to about 25 microns, said aggregate photoconductive layer having a maximum radiation absorption at a wavelength at least about 10 nm. different from the wavelength of maximum absorption of said thiapyrylium dye salt solubilized with said alkylidene diarylene group-containing polymer in a homogeneous composition, (b) said inorganic photoconductor-containing layer comprising an inorganic selenium-containing photoconductive material having an absorption band below about 600 nm.

8. A photoconductive insulating element as defined in claim 7 wherein said aggregate photoconductive layer contains an organic photoconductive material in solid solution with said continuous phase.

9. A photoconductive insulating element as defined in claim 7 wherein said inorganic photoconductor-containing layer has a dry thickness within the range of from about 0.1 to about 5 microns.

10. A photoconductive insulating element as defined in claim 7 wherein said inorganic photoconductor-containing layer consists essentially of selenium.

11. A photoconductive insulating element as defined in claim 7 wherein said aggregate photoconductive layer contains an organic photoconductive material in solid solution with said continuous phase, said organic photoconductive material being selected from the group consisting of arylamine photoconductive materials and polyarylalkane photoconductive materials.

12. A photoconductive insulating element as defined in claim 7 wherein said aggregate photoconductive layer contains an arylamine organic photoconductive material in solid solution with said continuous phase.

13. A photoconductive insulating element as defined in claim 7 wherein said aggregate photoconductive layer contains a polyarylalkane photoconductive material in solid solution with said continuous phase.

14. A photoconductive insulating element having at least two layers comprising an aggregate photoconductive layer contiguous to an inorganic photoconductor-containing layer, (a) said aggregate photoconductive layer having a dry thickness within the range of from about 0.5 to about 50 microns and comprising an organic photoconductive material in solid solution with a continuous, electrically insulating polymer phase and dispersed in said continuous phase a discontinuous phase comprisng a finely-divided, particulate, co-crystalline complex of (i) at least one polymer having an alkylidene diarylene group in a recurring unit and (ii) at least one thiapyrylium dye salt, said aggregate photoconductive layer having its principal absorption band of visible radiation within the range of from about 520 to about 700 nm, the particulate, co-crystalline complex of said discontinuous phase having a size of about 0.01 to about 25 microns, said aggregate photoconductive layer having a maximum radiation absorption at a wavelength at least about 10 nm. different from the wavelength of maximum absorption of said thiapyrylium dye salt solubilized with said alkylidene diarylene group-containing polymer in a homogeneous composition, (b) said inorganic photoconductor-containing layer being an electrically insulating composition having a dry thickness within the range of from about 0.5 to about 50 microns, said inorganic photoconductor-containing layer comprising an inorganic photoconductor dispersed in an electrically insulating binder, said inorganic photoconductor-containing layer comprising an inorganic zinc oxide photoconductor dispersed in an electrically insulating binder.

15. A photoconductive insulating element as defined in claim 14 wherein said organic photoconductive material contained in said aggregate photoconductive layer is selected from the group consisting of arylamine photoconductive materials and polyarylalkane photoconductive materials.

16. A photoconductive insulating element having at least two layers comprising an aggregate photoconductive layer contiguous to an inorganic photoconductor-containing layer, (a) said aggregate photoconductive layer having a dry thickness 2 to about 50 times thicker than said inorganic photoconductor-containing layer and comprising an organic photoconductive material in solid solution with a continuous, electrically insulating polymer phase and dispersed in said continuous phase a discontinuous phase comprising a finely-divided, particulate, co-crystalline complex of (i) at least one polymer having an alkylidene diarylene group in a recurring unit and (ii) at least one thiapyrylium dye salt, said aggregate photoconductive layer having its principal absorption band of visible radiation within the range of from about 520 nm to about 700 nm, the particulate, co-crystalline complex of said discontinuous phase having a size of about 0.01 to about 25 microns, said aggregate photoconductive layer having a maximum radiation absorption at a wavelength at least about 10 nm. different from the wavelength of maximum absorption of said thiapyrylium dye salt solubilized with said alkylidene diarylene group-containing polymer in a homogeneous composition, (b) said inorganic photoconductive-containing layer being an electrically insulating composition having a dry thickness within the range of from about 0.1 to about 5 microns, said inorganic photoconductor-containing layer comprising vacuum-deposited amorphous selenium.

17. A photoconductive insulating element as defined in claim 16 wherein said organic photoconductive material contained in said aggregate photoconductive layer is selected from the group consisting of arylamine organic photoconductive materials and polyarylalkane photoconductive materials.

18. A photoconductive insulating element as defined in claim 16 wherein said electrically insulating polymer phase of said aggregate photoconductive layer is a polycarbonate.

19. A photoconductive insulating element having at least two layers comprising an aggregate photoconductive layer contiguous to an inorganic photoconductor-containing layer, (a) said aggregate photoconductive layer having a dry thickness 2 to about 50 times thicker than said inorganic photoconductor-containing layer and comprising an organic photoconductive material in solid solution with a continuous, electrically insulating polymer phase and dispersed in said continuous phase a discontinuous phase comprising a finely-divided particulate, co-crystalline complex of (i) at least one polymer having an alkylidene diarylene group in a recurring unit and (ii) at least one thiapyrylium dye salt, said aggregate photoconductive layer having its principal absorption band of visible radiation within the range of from about 520 nm to about 700 nm, the particulate, co-crystalline complex of said discontinuous phase having a size of about 0.01 to about 25 microns, said aggregate photoconductive layer having a maximum radiation absorption at a wavelength at least about 10 nm. different from the wavelength of maximum absorption of said thiapyrylium dye salt solubilized with said alkylidene diarylene group-containing polymer in a homogeneous composition, (b) said inorganic photoconductor-containing layer being an electrically insulating composition having a dry thickness within the range of from about 0.5 to about 50 microns, said inorganic photoconductor-containing layer comprising a zinc oxide inorganic photoconductor dispersed in an electrically insulating binder.

20. A photoconductive insulating element comprising (a) a conductive support transparent to activating radiation for said element, (b) a polymeric subbing layer overcoating said support, (c) an aggregate photoconductive layer overcoating said subbing layer, and (d) an inorganic photoconductor-containing layer overcoating said aggregate photoconductive layer, (i) said aggregate photoconductive layer comprising a continuous, electrically insulating polymer phase and dispersed in said continuous phase a discontinuous phase comprising a finely-divided, particulate, co-crystalline complex of (i) at least one polymer having an alkylidene diarylene group in a recurring unit and (ii) at least one pyrylium-type dye salt, the particulate, co-crystalline complex of said discontinuous phase having a size of about 0.01 to about 25 microns, said aggregate photoconductive layer having a maximum radiation absorption at a wavelength at least about 10 nm. different from the wavelength of maximum absorption of said pyrylium-type dye salt solubilized with said alkylidene diarylene group-containing polymer in a homogeneous composition, (ii) said inorganic photoconductor-containing layer being an electrically insulating composition contiguous to said aggregate photoconductive layer and comprising an inorganic zinc oxide or selenium-containing photoconductor.

21. A photoconductive insulating element comprising (a) conductive support transparent to activating radiation for said element, (b) a polymeric subbing layer overcoating said support, (c) an inorganic photoconductor-containing layer overcoating said subbing layer, and (d) an aggregate photoconductive layer overcoating said inorganic photoconductor-containing layer, (i) said aggregate photoconductive layer comprising a continuous, electrically insulating polymer phase and dispersed in said continuous phase comprising a finely-divided, particulate, co-crystalline complex of (i) at least one polymer having an alkylidene diarylene group in a recurring unit and (ii) at least one pyrylium-type dye salt, the particulate, co-crystalline complex of said discontinuous phase having a size of about 0.01 to about 25 microns, said aggregate photoconductive layer having a maximum radiation absorption at a wavelength at least about 10 nm. different from the wavelength of maximum absorption of said pyrylium-type dye salt solubilized with said alkylidene diarylene group-containing polymer in a homogeneous composition, (ii) said inorganic photoconductor-containing layer being an electrically insulating composition contiguous to said aggregate photoconductive layer and comprising an inorganic zinc oxide or selenium-containing photoconductor.

22. A photoconductive insulating element comprising (a) a conductive support, (b) an aggregate photoconductive layer overcoating said support, and (c) an inorganic photoconductor-containing layer overcoating said aggregate photoconductive layer, (i) said aggregate photoconductive layer comprising a continuous-electrically insulating polymer phase and dispersed in said continuous phase a discontinuous phase comprising a finely-divided, particulate, co-crystalline complex of (i) at least one polymer having an alkylidene diarylene group in a recurring unit and (ii) at least one pyrylium-type dye salt, the particulate, co-crystalline complex of said discontinous phase having a size of about 0.01 to about 25 microns, said aggregate photoconductive layer having a maximum radiation absorption at a wavelength at least about 10 nm. different from a wavelength of maximum absorption of said pyrylium-type dye salt solubilized with said alkylidene diarylene group-containing polymer in a homogeneous composition, (ii) said inorganic photoconductor-containing layer being in electrical contact with said aggregate photoconductive layer and comprising an inorganic zinc oxide and selenium-containing photoconductor.

23. A photoconductive insulating element comprising (a) a conductive support, (b) an inorganic photoconductor-containing layer overcoating said support, and (c) an aggregate photoconductive layer overcoating said inorganic photoconductor-containing layer, (i) said aggregate photoconductive layer comprising a continuous, electrically insulating polymer phase and dispersed in said continuous phase a discontinuous phase comprising a finely-divided, particulate, co-crystalline complex of (i) at least one polymer having an alkylidene diarylene group in a recurring unit and (ii) at least one pyrylium-type dye salt, the particulate, co-crystalline complex of said discontinuous phase having a size of about 0.01 to about 25 microns, said aggregate photoconductive layer having a maximum radiation absorption at a wavelength at least about 10 nm. different from the wavelength of maximum absorption of said pyrylium-type dye salt solubilized with said alkylidene diarylene group-containing polymer in a homogeneous composition, (ii) said inorganic photoconductor-containing layer being in electrical contact with said aggregate photoconductive layer and comprising an inorganic zinc oxide or selenium-containing photoconductor.

24. In an electrophotographic process wherein an electrostatic charge pattern is formed by a photoconductive insulating element, the improvement wherein said photoconductive insulating element used to form said charge pattern is a photoconductive insulating element as defined in claim 22.

25. In an electrophotograhic process wherein an electrostatic charge pattern is formed by a photoconductive insulating element, the improvement wherein said photoconductive insulating element used to form said charge pattern is a photoconductive insulating element as defined in claim 23.

26. A photoconductive insulating element having at least two layers comprising an aggregate photoconductive layer in electrical contact with an inorganic photoconductor-containing layer, (a) said aggregate photoconductive layer comprising a continuous, electrically insulating polymer phase and dispersed in said continuous phase a discontinuous phase comprising a finely-divided, particulate, co-crystalline complex of (i) at least one polymer having an alkylidene diarylene group in a recurring unit and (ii) at least one pyrylium-type dye salt, said aggregate photoconductive layer having a maximum radiation absorption at a wavelength at least about 10 nm. different from the wavelength of maximum absorption of said pyrylium-type dye salt solubilized with said alkylidene diarylene group-containing polymer in a homogeneous composition, (b) said inorganic photoconductor-containing layer comprising an inorganic zinc oxide or selenium-containing photoconductor.

* * * * *